US005135582A

United States Patent [19]

Mochizuki et al.

[11] Patent Number: 5,135,582

[45] Date of Patent: Aug. 4, 1992

[54] METHOD FOR FORMING A DIAPHRAGM AND DIAPHRAGM

[75] Inventors: Osamu Mochizuki; Toshiharu Hoshi, both of Hamamatsu, Japan

[73] Assignee: Yamaha Corporation, Hamamatsu, Japan

[21] Appl. No.: 738,606

[22] Filed: Jul. 31, 1991

[30] Foreign Application Priority Data

Aug. 2, 1990 [JP] Japan ..... 2-205356
Sep. 13, 1990 [JP] Japan ..... 2-243603

[51] Int. Cl.[5] ..... C22C 21/00; G10K 13/00

[52] U.S. Cl. ..... 148/665; 148/400; 148/437; 148/564; 164/285; 181/168; 420/401; 420/552; 420/902; 72/483

[58] Field of Search ..... 148/11.5 A, 437, 11.5 R, 148/400; 420/401, 552, 902; 164/285; 181/168

[56] References Cited

U.S. PATENT DOCUMENTS 4,518,443 5/1985 Yokozeki et al. ..... 420/401

*Primary Examiner*—R. Dean
*Assistant Examiner*—Robert R. Koehler
*Attorney, Agent, or Firm*—Burns, Doane, Swecker & Mathis

[57] ABSTRACT

The present invention is directed to a method for producing a diaphragm for highly brittle metals used in loudspeakers, comprising a step of making a laminated plate by stacking a plate of superplastic material on a plate of highly brittle metal. The laminated plate is arranged on a mould, and the laminated plate is heated to a predetermined range of temperatures, determined according to the highly brittle metal. Subsequently, the laminated plate is deformed by pressuring the laminated plate in the mould, at the range of temperatures. Thus, a diaphragm can be formed from a plate of highly brittle metals, without causing brittle fracture or generating internal or surface defects.

16 Claims, 3 Drawing Sheets

METHOD FOR FORMING A DIAPHRAGM AND DIAPHRAGM

BACKGROUND OF THE INVENTION

1. Field of the Invention

The present invention relates to a method for forming a diaphragm from brittle material, for example, used in a loudspeaker device.

2. Prior Art

A hot press method or a hot isostatic press method is known for shaping metal plates.

However, these methods are used for metals having a high ductility, and are not applicable for shaping brittle metals such as berylium, which is suitable for diaphragms of high tone speakers. Therefore, a deposition method or a powder metallurgy method, must be adapted to form a metal plate from highly brittle materials, which has less productivity efficiency.

On the other hand, berylium has a small internal energy loss, therefore a diaphragm made of berylium has a strong peak of reasonance at a high frequency range. A diaphragm of ceramics such as $Al_2O_3$ or SiC, which is made by a moulding process, is inferior in efficiency of reproduction (regeneration) of sound because of its high density.

An object of the present invention is, therefore, to present a method of forming a diaphragm from a plate of highly brittle materials.

Another object of the present invention is to present a diaphragm having a higher performance than a conventional one.

SUMMARY OF THE INVENTION

The present inventin has been done to accomplish the object mentioned above, and is directed to a method for producing a diaphragm from highly brittle metals comprising:

(a) a process of making a laminated plate by stacking a plate of superplastic material on a plate of a highly brittle metal;

(b) a process of arranging the laminated plate on a mould;

(c) a process of heating the laminated plate to a predetermined range of temperature,which is determined by the highly brittle metal.

(d) a processof subsequently deforming the laminated plate, by pressuring the laminated plate into the mould at the predetermined range of temperature.

According to the present invention, a diaphragm can be formed from a plate of highly brittle metals, without causing brittle fracture or generating internal or surface defects. When the laminated plate is deformed, the plate of superplastic material and the plate of highly brittle metal deforms simultaneously, and the superplastic material plate acts to uniformly distribute pressure applied to the highly brittle metal plate.

Subsequently after the deformation process, by separating the superplastic material from the laminated plate, a diaphragm of highly brittle metal can be obtained. The superplastic material plates can be removed from the brittle metal plate when the laminated plate is taken from the mould. It is advisable to provide a releasing agent between the highly brittle metal plate, and the superplastic material plate, because it decreases the necessary work for separating. A suitable releasing agent is boron nitride or graphite.

As a highly brittle metal plate, berylium, or Ti-Al alloy comprising 24 to 26 at % of Ti and 74 to 76 at % of Al is suitable.

The temperature range,wherein the laminated plate is deformed, depends on the material of the highly brittle metal. The temperature range for berylium is from 400 to 1100 degrees celcius, and for Ti-Al alloy from 300 to 1300 degrees celcius. The temperature range depends on the deformability of the highly brittle metal, but also on the reactivity of the highly brittle metal to the releasing agent. The actual temperaturee is set, considering the temperature range, wherein the superplastic material shows the superplasticity. If the deformation temperature is lower than the range, the deformation resistance of the highly brittle metal plate will increase, which means, higher pressure is necessary for deformation thereof. If the deformation temperature is higher than the range, the melting point of the highly brittle metal becomes closer, and the highly brittle metal is likely to react with the releasing agent or the superplastic material.

The superplastic material, is known to elongate more than a few hundred % under tension of a certain temperature before it ruptures. Among various materials known to have superplasticity, a few of them are listed below as emamples, i.e., stainless steels, Al alloys, Mg alloys, Ti alloys, Ti-Al alloys and Hydroxy-apatite, etc.. These superplastic materials has a different temperature range of showing the superplasticity. Therefore, the deformation temperature, should be determined by considering the temperatures according to the superplastic material as shown in Table 1.

The laminated plate may be composed by, coupling a highly brittle metal plate and a superplastic material plate, or laminating two superplastic material plates on both sides of a highly brittle metal plate.

The rate of strain is controlled between $10^{-4}$ to 10/sec preferably. If the rate is over the range, the mould may rupture because of the high pressure and the uniformity of deformation may be spoiled. If the rate is under the range, the superplastic material plate is maintained at a high temperature for a time interval, the grain of the structure will grow coarse, and this will decrease the superplasticity deformability of the superplastic material plate.

The environment atmosphere preferably includes oxygen less than 1000 PPM, in order to prevent the degradation of material through oxidization.

The mould is formed to have at least one forging surface, which may have concavities or protrusions, according to the shape of the diaphragm.

Another invention relates to a diaphragm made from Ti-Al alloy, comprising of 24 to 26 atom % of Ti, 74 to 76 atom % of Al and residual of inevitable impurities.

If the ratio fo Ti to Al is not within a determined range, a diaphragm of inferior characteristics in a high tone range will be produced. With this ratio, the alloy have a intermetallic compound phase described as $TiAl_3$. The alloy can be composed through any conventional manufacturing process, such as mixing each element metal and melting them in a crucible.

Physical characteristics are described in comparison with other materials in TABLE 2.

TABLE 2

| | Density ($g/cm^3$) | Acoustic Velocity (m/sec) | Internal Loss (relative value) | Young Modulus ($10^4 kg/mm^2$) |
|---|---|---|---|---|
| Ti | 4.5 | 4,900 | 0.8 | — |
| Al | 2.7 | 5,200 | 0.8 | — |
| Be | 1.8 | 12,300 | 0.8 | — |
| $Al_2O_3$ | 4.0 | 10,400 | 0.7 | — |
| SiC | 4.1 | 11,100 | 0.7 | — |
| $TiAl_3$ | 3.37 | 8,000 | 1.0 | 2.2 |
| TiAl | 3.76 | 7,000 | — | 1.8 |
| $Ti_3Al$ | 4.5 | 5,400 | — | 1.3 |

According to the data above, in the Ti-Al alloy having a specific composition ($TiAl_3$), the acoustic velocity therein is large enough to regenerate a high tone signal adequately. Since the Ti-Al alloy has a large value of internal loss of energy, it can suppress the height of resonance peak at a high frequency range. Since the Ti-Al alloy has an appropriate density, the diaphragm of the alloy has a high efficiency for regenerating signals.

In order to maintain the necessary characteristic, impurities including oxygen is preferably limited to under 2 at %. By analyzing the structure of the alloy by X-ray difraction, the lattice planes are observed having interplaner spacing value as follows; 4.31Å, 3.52Å, 2.72Å, 2.30Å, 2.15Å, 1.93Å, 1.69Å, 1.57Å, 1.48Å, 1.44Å, 1.36Å, 1.27Å, 1.22Å, 1.17Å, 1.15Å.

DETAILED DESCRIPTION OF THE PREFERRED EMBODIMENTS

The preferred embodiment of the present invention will be described below.

FIGS. 1 to 4 depict a first embodiment of the present invention, producing a diaphragm of Ti-Al alloy.

Figure 1:
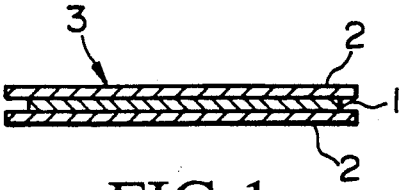
FIG. 1 is a cross-sectional view of a laminated plate used in the embodiments according to the present invention.

In this manufacturing process, a laminated plate is prepared in a process as described below, shown in FIG. 1. A material plate 1 of highly brittle metal, comprised of Ti-Al alloy of 40 μm thickness, is provided. The material plate is a flat plate composed of an alloy, consisting of 24.8 at % of Ti, 74.4 at % of Al and residual impurities, a main phase thereof is an interstitial metal composite of $TiAl_3$. Both the surfaces of the material plate, are painted with a releasing agent containing boron nitride powder. The material plate is stacked with two deforming plates 2 of 0.5 mm thickness, consisting of superplastic stainless steel SUS329, and is then formed into a laminated plate 3, by a process such as a rolling mill process.

The laminated plate 3 is then arranged in a mould 4. The mould 4 is comprised of an upper mould 5 and a lower mould 6. Each of them is provided with an edge portion 5*a*, 6*a* for holding the laminated plate 3 inbetween. The upper mould 5 has a recess 7 of a square cross section, for forming a space above the laminated plate 3, when the mould 4 is closed. An aperture 8 or a passage way for introducing gas inside of the upper mould 5 is provided with the upper mould 5. The lower mould 6 has a recess 10 of a half oval shape, which corresponds to the outer shape of a diaphragm for speakers. An aperture 11 for removing gas, is provided in the central of the lower mould 6.

After setting the laminated plate 3 on the mould 4, the laminated plate 3 is heated to 950 degrees celcius. Then Ar gas is blown through the aperture for superplastic deformation, into the space between the uper mould and the laminated plate 3. The laminated plate 3 deforms gradually until it is in abutment with the lower mould surface. The blowing speed of gas is controlled so that the rate of strain of the laminated plate 3 is $10^{-3}$ /sec. Subsequently maintaining the space at a pressure of 10 $kg/mm^2$ for 10 minutes makes the deformation process end.

Figure 4:
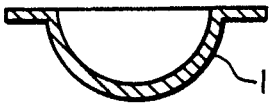
FIG. 4 is a cross-sectional view of the diaphragm manufactured through the first embodiment.
Figure 2:
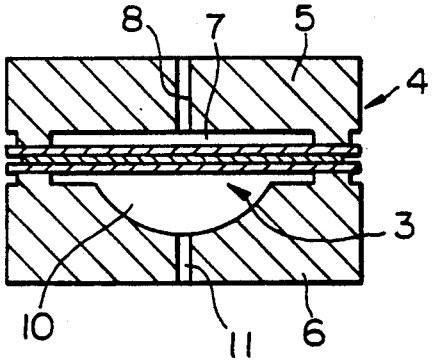
FIG. 2 is a cross-sectional view of a mould, used in the first embodiment of the present invention, when the laminated plate is set thereon.
Figure 5:
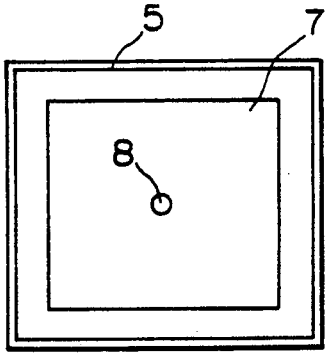
FIG. 5 is a plan view of the upper mould in FIG. 2.
Figure 3:
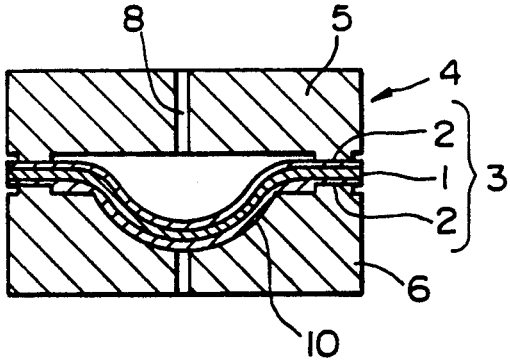
FIG. 3 is a cross-sectional view of the mould in FIG. 2 during deformation process.
Figure 6:
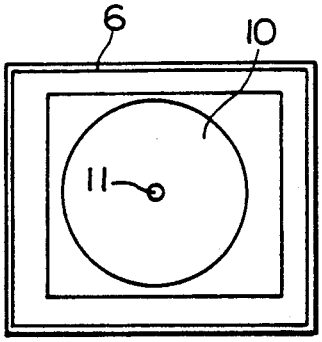
FIG. 6 is a bottom view of the upper mould in FIG. 2.

The laminated plate 3 is drawn out of the mould 4, and the deformation plates are removed mechanically, a diaphgram is obtained as shown in FIG. 4.

Figure 7:
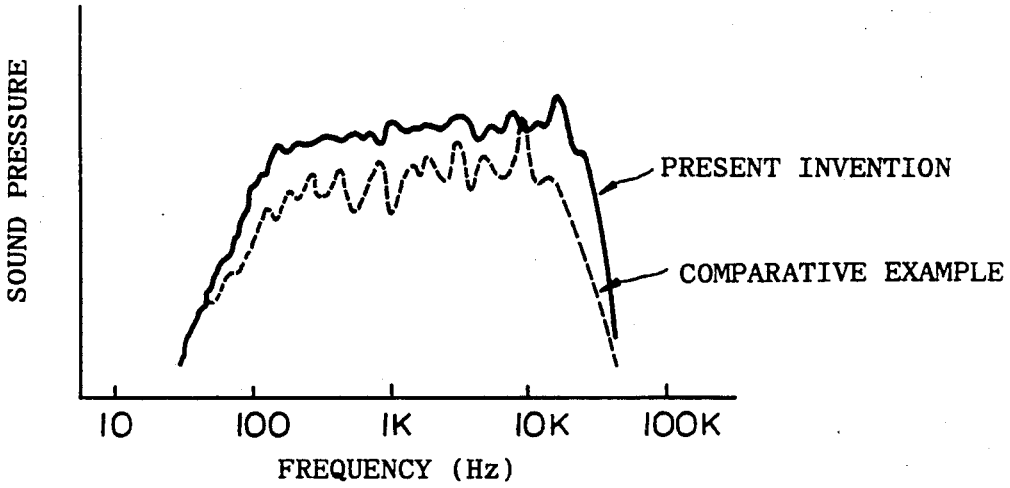
FIG. 7 is a graph showing frequency characteristics of signals from the diaphragm manufactured through the first embodiment of the invention.

The result of measuring a regeneration characteristics versus frequency of the diaphragm thus manufactured, is shown in FIG. 7. The regeneration characteristics of Ti, which is conventionally used as a diaphragm for high tone range, is also shown for comparison. The graph shows a good regeneration characteristic of the Ti-Al alloy diaphragm over a wide range of high frequency, and also a high efficiency of regeneration. The plate of superplastic material and the plate of highly brittle metal deforms simultaneously, so that the superplastic material plate, uniformize pressure, acting on the highly brittle metal plate. By the above mentioned process, such highly brittle metal as Ti-Al alloy, is formed into a necessary shape without causing a brittle fracture.

By applying a mould having plurality of recesses, a plurality of diaphragms are manufactured from one deformation process, and a high productivity is obtained.

SECOND PREFERRED EMBODIMENT OF THE INVENTION

Figure 8:
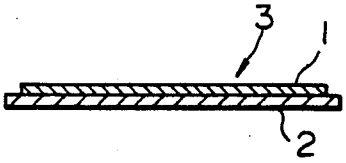
FIG. 8 is a laminated plate 3 used in the second embodiment of the invention.
Figure 11:
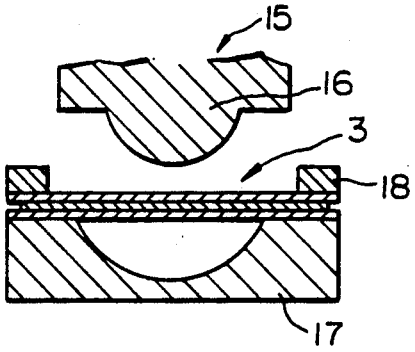
FIG. 11 is a cross-sectional view of a mould, used in the third embodiment of the present invention, when the laminated plate is set thereon.
Figure 9:
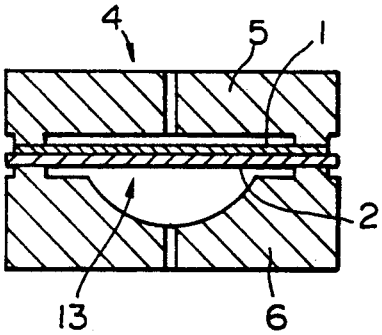
FIG. 9 is a cross-sectional view of a mould, used in the second embodiment of the present invention, when the laminated plate is set thereon.

The second embodiment of the invention will be described referring to FIGS. 8 and 9 below.

By this embodiment, a laminated plate 13 is composed by coupling a Ti-Al alloy plate 1, and a superplastic material plate 2 intervened by a releasing agent. The laminated plate 13 is arranged on a mould 4 to face the Ti-Al alloy plate to the upper direction. By the same deformation process as in the first embodiment, a good diaphragm is obtained.

THIRD PREFERRED EMBODIMENT OF THE INVENTION

The third embodiment of the invention will be described referring to FIGS. 10 to 13 below.

Figure 12:
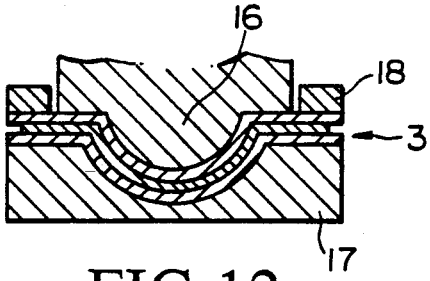
FIG. 12 is a cross-sectional view of the mould in FIG. 11 during deformation process.
Figure 10:
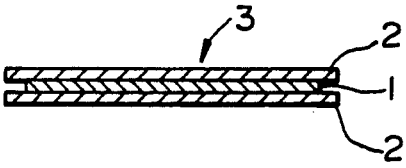
FIG. 10 is a laminated plate 3 used in the third embodiment of the invention.
Figure 13:
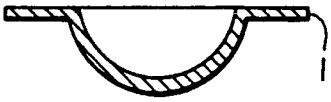
FIG. 13 is a cross-sectional view of the diaphragm manufactured through the third embodiment.

The laminated plate 3 is prepared as in the first embodiment. The laminated plate 3 is set on a mould 15, which is used for a hot press method. This mould 15 comprises a punch 16, a die 17 and a suppress ring 18, so that when the punch 16 and the die 17 are closed, a space shaped of a diaphragm is formed inbetween. The laminated plate 3, is secured on the die by fixing the edge portion by the suppress ring 18. The mould is set in an Ar gas atmosphere and heated to 950 degrees celcius. The punch 16 is gradually lowered to its lower limit as shown in FIG. 12. After removing the laminated plate 3 from the mould 15, the superplastic plate 2 is mechanically separated from the laminated plate 3, and a diaphragm is obtained without causing any brittle fractures.

FOURTH PREFERRED EMBODIMENT OF THE PRESENT INVENTION

Figure 14:
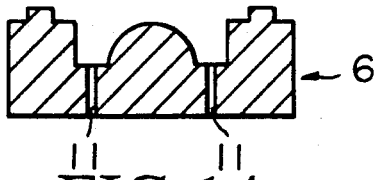
FIG. 14 is a cross-sectional view of a lower mould used in the fourth embodiment of the invention.

The fourth embodiment of the invention will be described referring to FIG. 14 below.

Al alloy containing 6 at% of Cu. 0.4 at% of Zr and the residual of Al, is used as the superplastic material of the deformation plate 2. The lower mould 6 is used as illustrated in FIG. 14. The deformation temperature is set at 400 degrees celcius, and the rate of strain is set to $10^{-4}$/sec. The material plate of Ti-Al alloy, has the same composition as in the first embodiment, and is formed into a diaphragm under the same conditions as in the first embodiment except for the above described. By this process, a diaphragm is obtained without causing any brittle fracture.

FIFTH PREFERRED EMBODIMENT OF THE INVENTION

Figure 17:
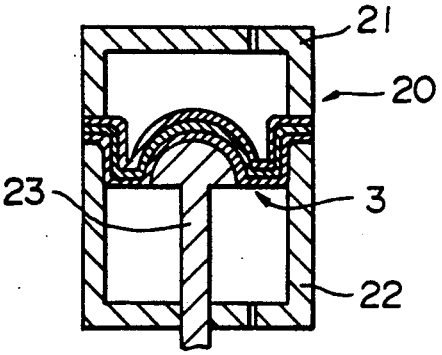
FIG. 17 is a cross-sectional view showing a process subsequently succeeding in FIG. 16.

The fifth embodiment of the invention will be described referring to FIGS. 15 and 17 below.

Figure 15:
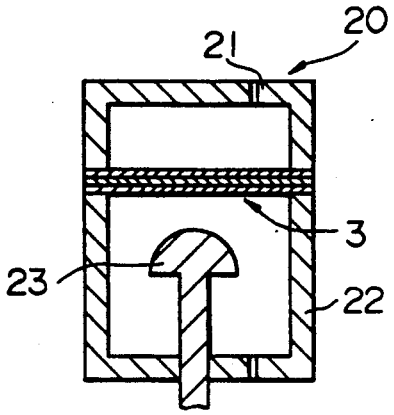
FIG. 15 is a cross-sectional view showing a process of the fifth embodiment of the invention.

The mould 20 as illustrated in FIG. 15, is used for forming the Ti-Al alloy with the same composition as in the first embodiment, and into the same shape as in the fourth embodiment. The mould 20 comprises of an upper mould 21 and a lower mould, defining a space of rectangular shape inbetween. A protruding mould 23 is arranged inside of the lower mould 22 to make it vertically movable. Apertures to follow the gas therethrough are also provided.

Figure 16:
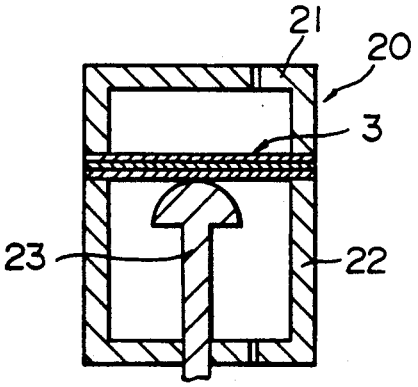
FIG. 16 is a cross-sectional view showing a process subsequently succeeding in FIG. 15.

The other conditions are the same as in the first embodiment. The laminated plate 3 is set and fixed between the upper and lower mould 21 and 22. Then the protruding mould 23 is moved upwards until it comes into an abutment with the laminated plate 3 as shown in FIG. 16. Ar gas is blown into the space between the upper mould 21 and the laminated plate 3, so that the laminated plate 3 is deformed along the protruding mould as shown in FIG. 17. By this process, a diaphragm is obtained without causing any brittle fractures.

SIXTH PREFERRED EMBODIMENT OF THE INVENTION

The sixth embodiment of the invention will be described below.

A diaphragm of berylium is manufactured by using the same apparatus as in the first embodiment. A material plate 1 of highly brittle metal comprised of berylium of 40 μm thickness is provided. Both the surfaces of the material plates are painted with a releasing agent, which contains boron nitride powder. The material plate is stacked with two deforming plates 2 of 0.3 mm thickness, consisting of superplastic stainless steel SUS329, and formed into a laminated plate 3 of one body. After setting the laminated plate 3 on the mould 4, the laminated plate 3 is heated up to 950 degrees celcius. Ar gas is blown into the space between the upper mould and the laminated plate 3, through the aperture in order to deform the laminated plate 3 in the super-plastic range at a strain speed of $10^{-3}$/sec. Subsequently maintaining the space at a pressure of 10kg/mm$^2$ for 10 minutes the deformation process ends. After the laminated plate 3 is drawn out of the mould 4, the deformation plates are removed mechanically, and a diaphragm of berylium is obtained as shown in FIG. 4.

OTHER EMBODIMENTS

By using the same material plate as in the sixth embodiment, and through the method of the second to the fifth embodiment, diaphragms of berylium are obtained.

What is claimed is:

1. A method for producing a diaphragm from highly brittle metals comprising:

(a) making a laminated plate by stacking a plate of superplastic material on a plate of a highly brittle metal;

(b) arranging the laminated plate on a mould;

(c) heating the laminated plate to a predetermined range of temperature, determined according to the highly brittle metal; and (d) subsequently deforming the laminated plate by pressuring the laminated plate into the mould at the range of the temperature.

2. A method for producing a diaphragm according to claim 1 comprising a step of separating the superplastic material from the deformed laminated plate.

3. A method for producing a diaphragm according to claim 1, wherein the step (a) includes a step of providing a releasing agent between the superplastic material and the highly brittle metal.

4. A method for producing a diaphragm according to claim 3, wherein the releasing agent includes boron nitride.

5. A method for producing a diaphragm according to claim 1, wherein the highly brittle metal is made from berylium.

6. A method for producing a diaphragm according to claim 1, wherein the highly brittle metal is made from a Ti-Al alloy comprising 24 to 26 atom % of Ti, 74 to 76 atom % of Al and the residual of inevitable impurities.

7. A method for producing a diaphragm according to claim 5, where the range of temperature is between 400° to 1100° C.

8. A method for producing a diaphragm according to claim 6, where the range of temperature is between 300° to 1300° C.

9. A method for producing a diaphragm according to claim 1, where the superplastic material is comprised of one selected group, containing stainless steel, Al alloy, Mg alloy, Ti alloy, Ti-Al alloy and Hydroxy-apatite.

10. A method for producing a diaphragm according to claim 1, where the laminated plate includes a plate of highly brittle metal and two plates of superplastic material, which are laminated on both sides of the highly brittle metal.

11. A method for producing a diaphragm according to claim 1, where the rate of strain in the deformation is set between $10^{-4}$ to $10^{1}$/s.

12. A method for producing a diaphragm according to claim 1, where the environment atmosphere includes less than 1000 PPM of oxygen.

13. A method for producing a diaphragm according to claim 1, where the deformation is conducted by gaseous pressure.

14. A method for producing a diaphragm according to claim 1, where the deformation is conducted by pressuring the laminated plate through a counter mould.

15. A diaphragm comprising:

a plate made from Ti-Al alloy for reproducing sound, said plate further comprising:

24 to 26 atomic % of Ti;

74 to 76 atomic % of Al; and a residual of inevitable impurities.

16. A diaphragm made from a Ti-Al alloy of 24 to 26 atomic % of Ti, 74 to 76 atomic % of Al and a residual of inevitable impurities, said diaphragm being made by a process which includes the steps of;

(a) making a laminated plate by stacking a plate of superplastic material on a plate of the Ti-Al alloy;

(b) arranging the laminated plate on a mould;

(c) heating the laminated plate to a temperature between 300° and 1300° C.; and (d) subsequently deforming the laminated plate by pressuring it into the mould at said range of temperatures.

* * * * *